US005683113A

United States Patent [19]

Petrucci

[11] Patent Number: 5,683,113

[45] Date of Patent: Nov. 4, 1997

[54] EDGE MOUNTED INDEX TAB

[76] Inventor: Ferdinand A. Petrucci, 132 Brooklea Dr., Rochester, N.Y. 14624

[21] Appl. No.: 727,223

[22] Filed: Oct. 8, 1996

[51] Int. Cl.[6] ..... B42F 21/00

[52] U.S. Cl. ..... 283/36; 283/39; 40/359

[58] Field of Search ..... 283/39, 40, 41, 283/42, 36, 37, 38; 40/359; 402/79; 462/6

[56] References Cited

U.S. PATENT DOCUMENTS

| | | | |
|---|---|---|---|
| 808,909 | 1/1906 | Duncan et al. | 462/6 |
| 2,260,407 | 10/1941 | Schade | 40/359 |
| 5,135,261 | 8/1992 | Cusack et al. | 462/6 |
| 5,160,296 | 11/1992 | Katz | 462/6 |
| 5,187,888 | 2/1993 | O'Brien et al. | 462/6 |
| 5,503,487 | 4/1996 | Ong | 402/79 |

FOREIGN PATENT DOCUMENTS

| | | | |
|---|---|---|---|
| 155855 | 9/1956 | Sweden | 40/359 |

*Primary Examiner*—Willmon Fridie, Jr.

*Attorney, Agent, or Firm*—Patent & Trademark Services; Joseph H. McGlynn

[57] ABSTRACT

An improved index tab which comprises a rectangular portion which provides a space for the placement of labels or other indicia. Extending from adjacent corners along the longitudinal margin of the rectangular portion are upper and lower feet. The lower foot is semi-elliptical, having a linear edge parallel to the longitudinal margin of the rectangular portion. The upper foot extends outward from the longitudinal margin of the rectangular portion, curving slightly downward relative thereto. A slotted offset is disposed between the upper foot and the rectangular portion. Upper and lower feet are inserted into corresponding holes along the folded edge of an item having a folded edge. A slight downward pull on the rectangular portion locks the edge of the upper hole into the slotted offset, and a pull in the opposite direction allows removal of the index tab.

3 Claims, 1 Drawing Sheet

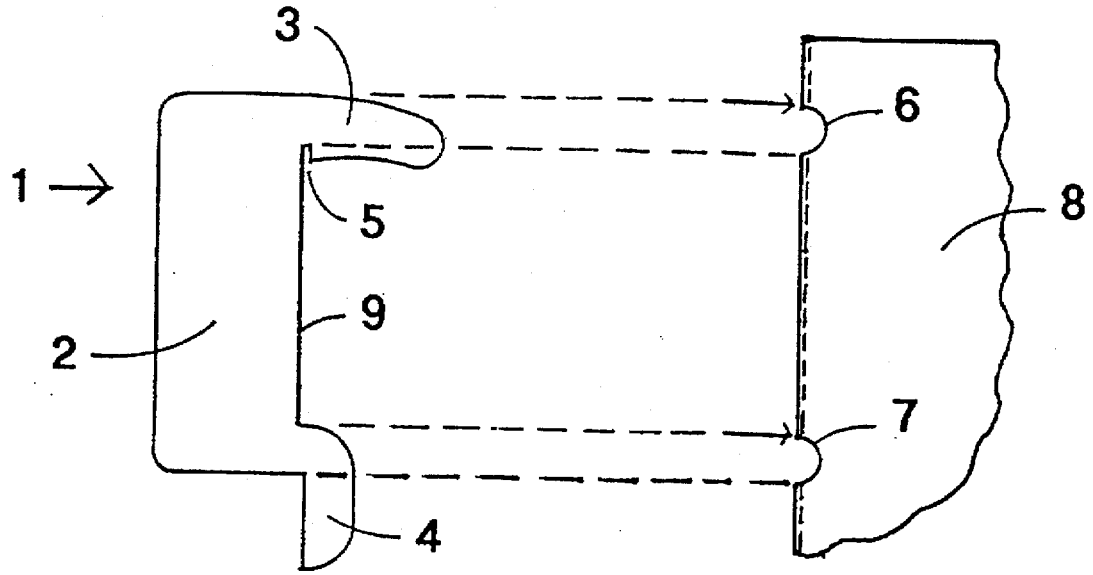
FIG. 1
FIG. 4
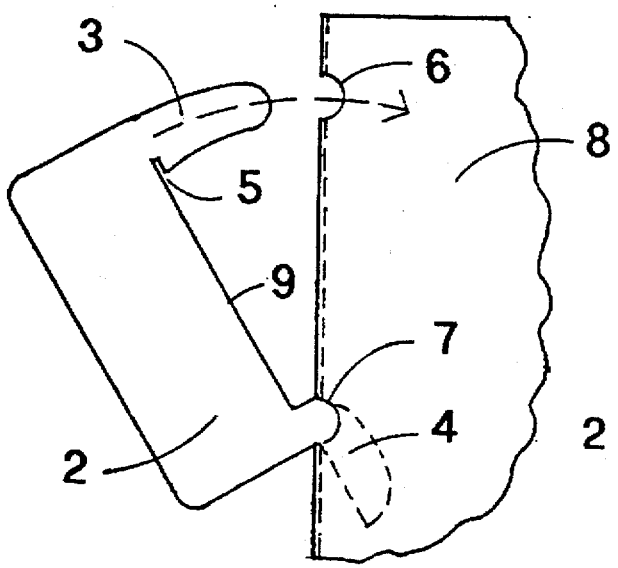
FIG. 2
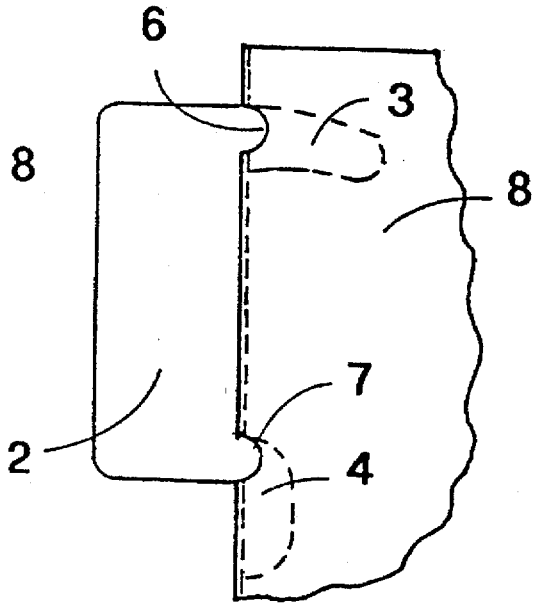
FIG. 3

EDGE MOUNTED INDEX TAB

BACKGROUND OF THE INVENTION

The present invention relates generally to tabs for indexing file folders and the like, and in particular to an index tab having means for detachable attachment to the folded edge of file folders and similar items.

DESCRIPTION OF THE PRIOR ART

It is known in the art to label and to organize file folders and similar items using index tabs connected to the margins of the items. As described below, however, the prior art inventions do not provide attachment means which are both secure and easily detachable. In addition, the prior art tab devices are neither durable nor esthetically desirable.

The prior art index tabs having adhesive attachment means suffer from several drawbacks. U.S. Pat. No. 5,135,261 describes an index tab label assembly having a pressure sensitive adhesive backing and an outer coating to facilitate printing on the label. This device cannot be removed from file items once it has been connected thereto. In addition, it cannot be connected to the folded edges of filed items, since the opening and closing at the fold would cause the device to become torn and damaged.

U.S. Pat. No. 5,187,888 describes an adhesive-backed index tab having opposing bilaterally symmetric portions. This invention, as well, cannot be removed once it is attached to an item, and it is also not suitable for attachment at the folded edge of a filed item.

The prior art index tabs using non-adhesive attachment means are generally inconvenient and unsuited for secure attachment to different types of filed items. U.S. Pat. No. 808,909 describes a tab for cards in a card index system. This invention cannot be attached to the folded edge of a file item, as it would tend to become detached. It is also cumbersome and unattractive.

U.S. Pat. No. 5,160,296 discloses a directory tab supported in a rigid plastic frame which is inserted into preexisting notches of a suspended folder. This device is suitable only for a very specific type of folder. It is also quite obtrusive and therefore unsuited for use in cluttered file drawers.

There clearly remains a need for an index tab device which can be securely attached to and easily removed from, filed items. The present invention provides a convenient, attractive, and inexpensive device which can be used to tab and index file folders and similar items. Among other advantages, invention has detachable attachment means which enable it to be connected easily to the folded edge of many different types of file items.

SUMMARY OF THE INVENTION

The present invention is an improved index tab, preferably constructed from hard plastic or laminated cardboard. The index tab of the present invention is designed to be securely attached at the folded edge of file folders and similar items. It is durable and attractive, and can be readily detached when desired.

The tab comprises a generally rectangular portion for the placement of a label. Extending from adjacent corners of the label portion on its longitudinal margin are upper and lower feet, which are inserted into holes along the folded edge of file items. The lower foot is semi-elliptical in shape, having a linear edge extending parallel to the longitudinal of the label portion. The upper foot extends outward from the longitudinal of the label portion, curving slightly downward relative thereto. A slotted, offset portion is disposed between the longitudinal margin of the label portion and the upper foot.

To use the invention, the lower foot is inserted into a hole which is punched at the desired spot on the folded edge of a file item. The upper foot is then rotated towards the file item and the upper foot is inserted into an adjacent hole. A slight downward tug on the label portion interlocks the slotted offset with the folded edge of the file item. The index tab is thus securely attached to the folded edge of the file item, and can be removed by a slight tug in the opposite direction to release the edge of the file item from the slotted offset.

Accordingly, it is an object of the present invention to provide an improved index tab device.

It is a further object of this invention to provide an index tab device that is inexpensive, convenient, and attractive.

It is still further an object of this invention to provide an index tab device that may be easily attached and detached from file folders and similar items.

It is still further an object of this invention to provide an index tab device that can be securely attached to the folded edge of file folders and similar items.

These and other objects and advantages of the present invention will become fully apparent from the detailed description below, when taken in conjunction with the annexed drawings.

BRIEF DESCRIPTION OF THE DRAWINGS

FIG. 1 shows a plan view of the index tab of the present invention.

FIG. 2 shows a plan view of the index tab partially inserted into the folded edge of a file folder, with shadow lines depicting obscured portions.

FIG. 3 shows a plan view of the index tab of the present invention installed on a file folder, again with shadow lines depicting obscured portions.

FIG. 4 is a view of the folder which the tab will be attached to.

DESCRIPTION OF THE PREFERRED EMBODIMENT

Referring now to the drawings in greater detail, it can be seen in FIG. 1 that the index tab 1 of the present invention comprises a generally rectangular portion 2 and feet 3, 4 extending from adjacent corners of the rectangular portion 2 along its longitudinal margin 9. Lower foot 4 is a semi-elliptical portion having a linear edge parallel to the longitudinal margin of the rectangular portion 2. Upper foot 3 extends outwardly from the rectangular portion, curving slightly downward relative to the longitudinal margin 9 of the rectangular portion 2. A slotted offset 5 is disposed between the upper foot 3 and the rectangular portion 2.

FIGS. 2 and 3 taken together illustrate the installation of the index tab 1 on a file folder 8. As shown in FIGS. 2 and 3, a file folder 8 has holes 6, 7 punched along its folded edge, the holes 6, 7 being positioned to receive upper and lower feet 3, 4. To install the index tab 1 on a file folder 8, the lower foot 4 is inserted into lower hole 7, as shown in FIG. 2, and the upper foot 3 is rotated toward the folded edge of the file folder 8. The upper foot 3 is received into the upper hole 6 as illustrated in FIG. 3, and the linear edge of the lower foot 4 is brought to bear against the inside of the folded edge of the folder. A slight pull on the index tab 1 in the direction of the lower foot 4 locks the edge of the upper hole 6 into the slotted offset portion 5 between the upper foot 3 and the rectangular portion 2. A slight tug in the opposite direction releases the index tab 1 so that it may be removed when desired.

In use, the index tab 1 of the present invention provides a convenient, unobtrusive, and attractive device for indexing file folders and similar items. Rectangular portion 2 provides a space for the placement of labeling indicia, which may be accomplished using various means. For example, adhesive labels may be placed on the rectangular portion 2 to identify the contents of file items. Alternatively, written indicia may be placed directly on the rectangular portion 2. Rectangular portion 2 may also be constructed from pleated, transparent material with a slot for the insertion of paper labels.

The index tab 1 may be easily installed and removed by the process described above, providing the means to quickly relabel and reorganize file items.

The index tab 1 may be constructed from hard plastic, laminated cardboard, or any other suitable material of an approximate thickness of 1/32". The index tab 1 can be constructed in various sizes to accommodate commercially available adhesive labels. Preferably, the index tab 1 could be available in a size which would correspond with standard three-hole punched items.

In addition, although the index tab of the present invention is shown as being rectangular, it could also be made in other shapes, if desired, without departing from the scope of the present invention.

Also, although the present invention has been described as being applied to file folders or similar items, it should be noted that it may also be used with other items. For example the present invention may also be applied to a multitude of published documents having a folded edge such as, but not limited to, magazines, report covers, pocket/binder folders, product portfolios, technical support manuals, owners manuals, operation manuals, product catalogs, annual stock reports, envelopes and vintage record jackets. The present invention provides a convenient and inexpensive way to "hang" a variety of items for storage and/or display.

In order to attach the present invention to an item such as a magazine, all that is necessary is the user must punch holes in the folded part of the magazine or other folded item. This can be accomplished by using a standard paper hole punch. Once the proper number and size holes are punched, the tab of the present invention may be inserted in the same manner as described above for attachment to file folders.

Although the index tab and the method of using the same according to the present invention has been described in the foregoing specification with considerable details, it is to be understood that modifications may be made to the present invention which do not exceed the scope of the appended claims and modified forms of this invention done by others skilled in the art to which the invention pertains will be considered infringements of this invention when those modified forms fall within the claimed scope of the invention.

What I claim as my invention is:

1. An index tab for attachment to the folded edge of an item, said item having a longitudinal, folded edge with at least two spaced apertures therein, said index tab comprising:

a base member, said base member having surface means for receiving indicia, and at least one longitudinal margin, a first projection extending parallel to said surface means and perpendicular to said longitudinal margin, slot means between said first projection and said longitudinal margin, for receiving a portion of one of said spaced apertures, a second projection having a first portion extending parallel to said surface means and perpendicular to said longitudinal margin, and a second portion extending parallel to said surface means and parallel to said longitudinal margin.

2. The index tab for attachment to the folded edge of an item as claimed in claim 1, in combination with said item, said item having a pair of spaced apertures in one edge thereof, said first projection engaged with one of said pair of first apertures, and said second projection engaged with the other of said pair of spaced apertures, said slot means engaged with a edge of one of said pair of first apertures.

3. A method of attaching the index tab as claimed in claim 1 with an item, said method comprising:

placing at least a pair of apertures into an edge of said item, inserting said first projection into one of said pair of apertures, and inserting said second projection into the other of said pair of apertures, moving said index tab downward until said slot means engages an edge of said one of said pair of first apertures.

* * * * *